United States Patent [19]

Nichols

[11] 4,215,864

[45] Aug. 5, 1980

[54] WORD PUZZLE GAME

[76] Inventor: David L. Nichols, 6705 N. 12th Pl., Phoenix, Ariz. 85014

[21] Appl. No.: 930,481

[22] Filed: Aug. 2, 1978

[51] Int. Cl.[2] ..... A63F 9/06

[52] U.S. Cl. ..... 273/153 R

[58] Field of Search ..... 273/153 R, 240, 272; 35/35 R

[56] References Cited

U.S. PATENT DOCUMENTS

| | | |
|---|---|---|
| 2,050,498 | 8/1936 | Mitchell . |
| 2,124,136 | 7/1938 | Bugg . |
| 2,684,853 | 7/1954 | Withers . |
| 2,782,530 | 2/1957 | Larroca . |
| 3,411,221 | 11/1968 | Clark . |
| 3,746,342 | 7/1973 | Fine . |
| 3,877,703 | 4/1975 | Pierre . |

OTHER PUBLICATIONS

"Teleword," TV Channels, The Washington Post, Jun. 17, 1979.

"Junior Jumble," The Washington Post Comics, Second Section, p. 1, May 20, 1979.

"Quote-Acrostic," The Washington Post Magazine, p. 42, May 20, 1979.

*Primary Examiner*—Anton O. Oechsle

*Attorney, Agent, or Firm*—Charles E. Cates

[57] ABSTRACT

The specification discloses a word puzzle game whose elements are: a substrate which carries a letter field of spaces defined by lines on the substrate; a letter in each space; means associated with the spaces for indicating the removal from play of the letters after they have been used; a set of word clues associated with and keyed to the letter field; and a puzzle statement whose solution is dependent upon the proper solution of said word clues and which is revealed by the letters and the unused spaces of the letter field. All word clues and puzzle statement solutions are lettered in sequence, but may run in any direction—up, down, across, backward or diagonally, and no letters are used more than once.

In play, the player considers word clues, solves each clue by finding the word answer in the unused letters in the letter field, indicates their removal from play by marking the means provided for that purpose, then considers a conundrum which is posed and finds the answer in the words which can be formed from the remaining unused letters in the letter field.

6 Claims, 2 Drawing Figures

WORD PUZZLE GAME

BACKGROUND OF THE INVENTION

This invention relates to word puzzle games.

In the prior art are found several variations of crossword puzzle games, word clue games and the like which are devised and printed for the entertainment and education of the public. The appeal of such games is to the intellect of the player, and provides a pleasant pastime if within the capabilities of the game player.

Examples of some of the prior art games are to be found in the following U.S. Pat. Nos.: Mitchell 2,050,498; Bugg 2,124,136; Withers 2,684,853; Larroca 2,782,530; Clark 3,411,221; Fine 3,746,342; Pierre 3,877,703.

Another type of word game puzzle found in the prior art is one that appears as a syndicated item in many daily newspapers known as "Jumble" wherein a set of scrambled letters is presented. Each set of scrambled letters must be rearranged to make a word to fit into appropriate spaces, some of which are circled. A new set of scrambled letters is selected from the circled letters in the solved words from which a solution is formed by rearranging the letters to answer or meet the requirements of a word in a pictured clue.

Notwithstanding the existence of a variety of word puzzle games in the prior art there is a constant demand for new and unusual word games for the market.

Accordingly, I have invented a new word game that is entertaining, educational and challenging to the intellect.

BRIEF SUMMARY OF THE INVENTION

The invention is a word puzzle game, the elements of which are: a substrate carrying a letter field of spaces defined by lines on the substrate, each said space including an area containing a letter and means in areas separate and distinct from said letter containing areas for indicating that letters associated with said spaces have been used and thereby removed from further play; a set of word clues associated with and keyed to the letter field; and a puzzle statement whose solution is dependent upon proper solution of the word clues and which is contained in the unused letters in the spaces of the letter field remaining after the clues are solved.

The puzzle statement conveniently may be a conundrum and the letter field may be marked off in squares with subordinate squares within the squares provided as means for indicating the use of spaces during the play of the game. Numbers may also be used to identify the spaces.

DETAILED DESCRIPTION OF THE PREFERRED EMBODIMENT

Figure 1:
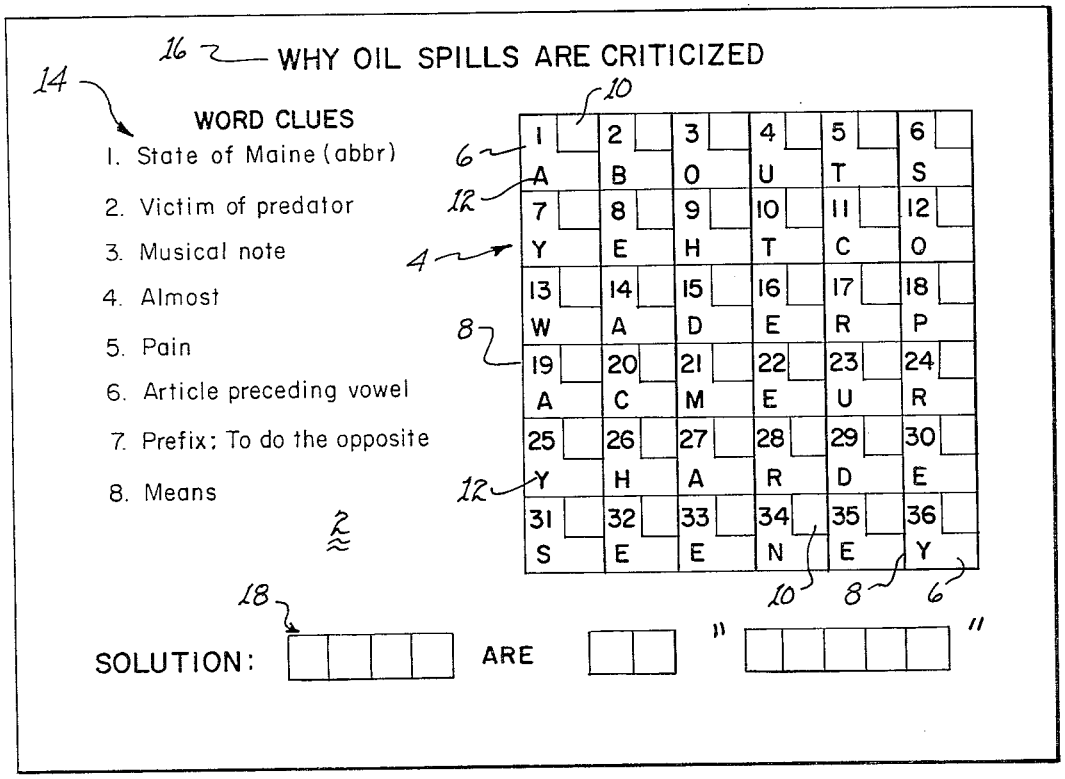
Figure 2:
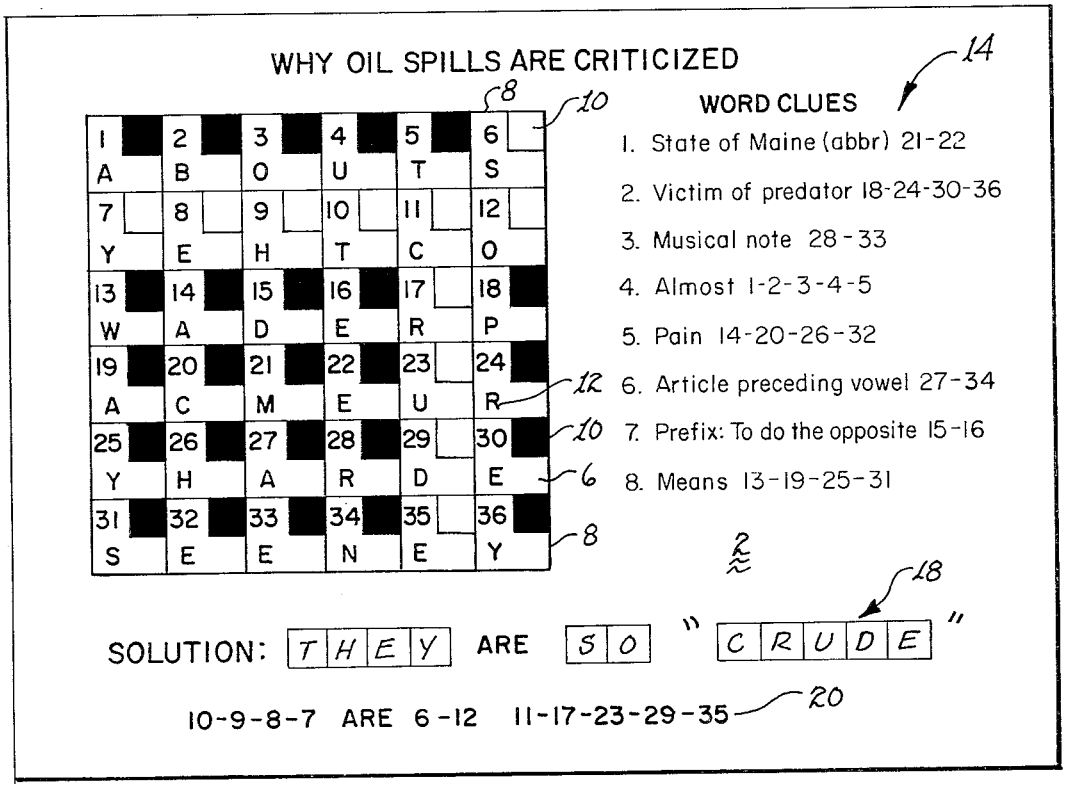

Various features, advantages and objects of this invention will become apparent from a consideration of the following detailed description of the presently preferred embodiment of the invention and the various examples thereof, all of which are to be read in connection with the accompanying drawing, wherein:

FIG. 1 is an illustration of a word puzzle game embodying the present invention as it appears prior to solution; and FIG. 2 is an illustration of the solved puzzle.

Referring now to the details of FIG. 1 of the drawing, the substrate 2 is a paper upon which is printed a field of letters generally indicated as 4. Spaces 6 are defined by printed lines 8 which mark the field off in a grid of squares. Within each space 6 is a letter 12 and a subordinate square 10 which when "X'd" or in some other fashion marked serves as an indicator that the letter 12 associated with the space 6 has been used and thereby removed from play and further consideration.

A conundrum 16 is posed to the player in connection with the playing of the puzzle game. Word clues indicated generally as 14 are provided and the ultimate object is to find the answer to the conundrum which is recorded in the boxes 18 provided for the answer to the conundrum.

In playing the game the player considers each of the word clues 14 individually and searches through the field of letters for the appropriate solution to each clue. All solutions are words formed in sequence, but they may run in any direction—up, down, across, backward or diagonally. However, no letters in the field are used more than once.

The elimination of the letters used to solve the word clues is indicated by marking the associated squares 10. The answer to the conundrum is found in the words that can be formed out of the unused letters.

Turning now to FIG. 2, the word puzzle game depicted in FIG. 1 is shown after solution. For example, the solution to word clue No. 1 was found in spaces 21 and 22 (interior markings) and during the play these spaces were therefor marked. The solution to word clue No. 5 was found in numbered spaces 14, 20, 26 and 32 and these were appropriately marked; and as each of the word clues is solved the appropriate squares in the spaces were marked to indicate the associated letters that were out of play. After solving all of the word clues the spaces numbered 10, 9, 8, 7, 6, 12, 11, 17, 23, 29, 35 remained, the associated letters of which provided the answer to be filled in the solution blocks: i.e., THEY ARE SO "CRUDE".

It will be apparent to persons ordinarily skilled in the art that certain equivalent variations, modifications and improvements of the invention may be made within the spirit of this invention which is limited only by the appended claims.

I claim:

1. A word puzzle game comprising:

(a) a substrate;

(b) a letter field carried by said substrate and comprising letter spaces defined by lines on said substrate, each space including an area containing a letter and means comprising subordinate spaces lined within said spaces in areas separate and distinct from said letter containing areas for indicating said spaces and associated letters have been used and thereby removed from further play;

(c) a set of word clues associated with and keyed to said letter field;

(d) a puzzle statement whose solution is dependent upon the proper solution of said word clues, and which is revealed by the letters in the unused spaces of said letter field when said clues are solved and said means for indicating used spaces is employed.

2. The game of claim 1 wherein said puzzle statement is a conundrum.

3. The game of claim 1 wherein said letter spaces are in the form of squares and said subordinate spaces comprise subordinate squares lined within the squares.

4. The game of claim 1 wherein said substrate is paper.

5. The game of claim 1 wherein said spaces are each marked with an identifying number.

6. The game of claim 1 wherein each one of said letters is associated with only one of said word clues or said puzzle statement.

* * * * *